US005206995A

United States Patent [19]

Min

[11] Patent Number: 5,206,995

[45] Date of Patent: May 4, 1993

[54] SAFETY RAZOR

[76] Inventor: Bosik Min, Rm. 102, Changhunvilla Na-Dong, 106-3, Munjong Dong, Songpa Gu Seoul, Rep. of Korea

[21] Appl. No.: 944,549

[22] Filed: Sep. 14, 1992

[30] Foreign Application Priority Data

Sep. 19, 1991 [KR] Rep. of Korea ..... 91-15396
Aug. 13, 1992 [KR] Rep. of Korea ..... 92-15259

[51] Int. Cl.[5] ..... B26B 21/14
[52] U.S. Cl. ..... 30/89; 30/87
[58] Field of Search ..... 30/87, 89

[56] References Cited

U.S. PATENT DOCUMENTS 2,676,396 4/1954 Testi ..... 30/89
3,685,150 8/1972 Risher ..... 30/89
3,740,841 6/1973 Risher ..... 30/89
4,266,340 5/1981 Bowman ..... 30/89
4,288,920 9/1981 Douglas et al. ..... 30/89
4,347,663 9/1982 Ullmo ..... 30/89

*Primary Examiner*—Frank T. Yost
*Assistant Examiner*—Hwei-Siu Payer
*Attorney, Agent, or Firm*—Brady, O'Boyle & Gates

[57] ABSTRACT

An improved safety razor comprises an elongate shank having a blind bore at the top thereof, a closure member removably secured to the elongate shank for closing off the bore of the shank, a blade carriage pivotably mounted on the closure member and a compression spring for biasing the blade carriage in one direction. The blade carriage includes a blade carrying head an elongate lever extending rearwardly from the head to its pivot point. The blade carriage is subjected to pivotal movement between a first position in which the lever of the blade carriage is substantially perpendicular to the axis of the shank and a second position which is angularly spaced a predetermined degree from the first position.

3 Claims, 3 Drawing Sheets

SAFETY RAZOR

FIELD OF THE INVENTION

The present invention relates to a safety razor and, more specifically, is concerned with an improved safety razor which enables a razor blade to move in a close conformity with the curvature of the user's face, thereby making it possible to get a clean shaving in an effective manner.

DESCRIPTION OF THE PRIOR ART

It is well-known in the art that a safety razor is able to get a relatively clean shaving in a speedy way with little possibility of leaving a cut or scar on the user's face. One of the typical safety razors is a pivot-headed razor which includes an elongate shank and a head or blade carriage pivotally mounted on the shank. In the pivot-headed razor, the head is adapted to pivot within a predetermined angular range so that a blade carried by the head can move along the curvature of the face to have mustache cut. The pair art razor of the class described above, however, poses a problem that the relative angle of the blade with respect to the face becomes unstable, which in turn, reduces the cutting efficiency and, in the worst circumstance, causes a cut on the face. This is because the head is free to rotate about its pivot axis without any restriction. In addition, since the head has a tendency to pivot toward its uppermost angular position as the razor is pulled down along the face, it is difficult to properly change the range of the blade in compliance with the face's curvature.

Another example of the prior art safety razor comprises an elongate shank, a head carried by the shank for pivotal movement between an lowermost angular position and an uppermost angular position and a spring for urging the head toward the lowermost angular position. Although this type of safety razor has been successful to some extent in restraining the pivotal movement of the razor head, it is disadvantageous in that the radius of rotation of the head is too small to have the blade strictly follow the curvature of the face. The reason for this is that the head is directly mounted on the shank without any intermediate element being provided therebeween. Another disadvantage of the prior art razor set forth immediately above is that t spring is not easy to assemble or disassemble and tends to loose its resiliency when the razor is in service for a long period of time.

SUMMARY OF THE INVENTION

Accordingly, it is an object of present invention to provide a safety razor which enables its b lade to move in close conformity with the curvatures of the face, while maintaining an optimal cutting angle, consequently making it possible to get a clean shaving without the likelihood of leaving a cut or scar on the face.

Another object of the present invention is to provide a safety razor comprising an improved biasing means which can be readily assembled with or disassembled from the razor and which is capable of keeping its resiliency for an extended period of time.

In accordance with the present invention, there is provided a safety razor comprising: an elongate shank having a blind bore at the top thereof; a closure member removably secured to the elongate shank for closing off the bore of the shank, said closure member having an axial hole formed along an axis of the shank; a blade carriage pivotably mounted on the closure member, said blade carriage including a blade-carrying head and a lever extending rearwardly from the head over the axial hole of the closure member to its pivot pint, said blade carriage pivotable between as first position in which the lever is substantially perpendicular to the axis of the shank and a second position which is angularly spaced a predetermined degree from the first position, said lever having an aperture formed in alignment with the axial hole of the closure member; and means, amounted through the aperture of the lever and the axial hole of the closure member, for biasing the blade carriage toward the first position.

BRIEF DESCRIPTION OF THE DRAWINGS

The above and other objects, features and advantages of the invention will become apparent form the following description of the preferred embodiments taken in conjugation with the accompanying drawings in which.

DETAILED DESCRIPTION OF THE PREFERRED EMBODIMENTS

Figure 1:
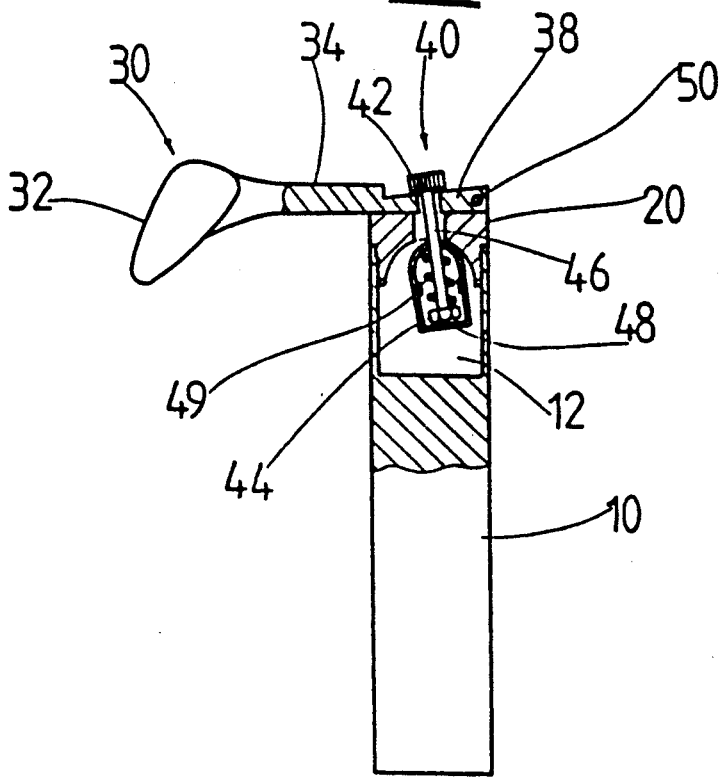
FIG. 1 is a partially cutaway, side elevational view of the safety razor in accordance with the first embodiment of the present invention.
Figure 2:
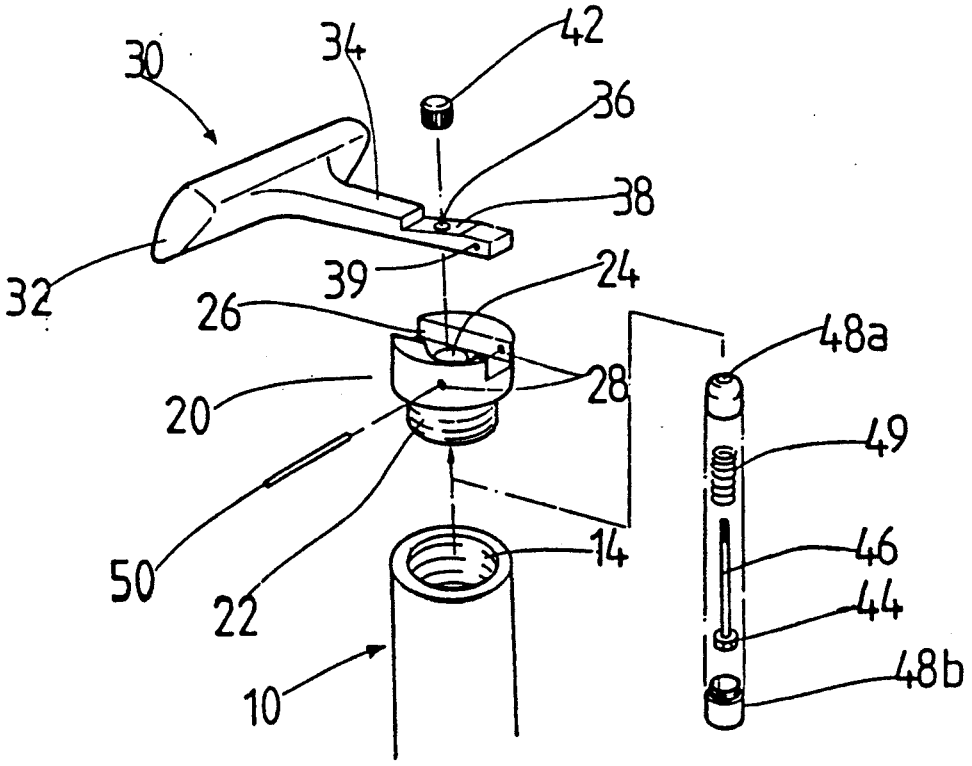
FIG. 2 is an exploded perspective view showing the safety razor of the first embodiment.
Figure 3:
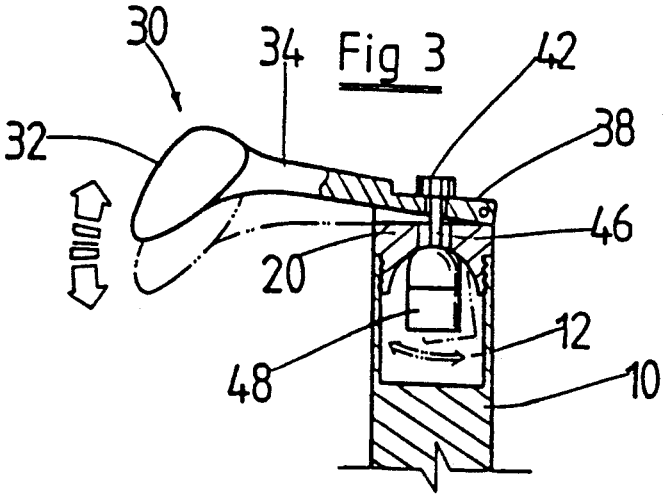
FIG. 3 show the safety razor of the first embodiment with the blade carriage pivoted to the uppermost position against the spring face.

Referring to FIGS. 1 to 3, the safety razor in accordance with the first embodiment o the invention comprises an elongate shank 10 having a blind bore 12 opened at its top edge. Along a partial length of he bore 12, there is provided a female thread 14 as clearly shown in FIG. 2. A closure member 20 is threadedly engaged with shank 10 to close off the bore 12 of elongate shank 10. The closure member 20 includes a male thread 22 adapted to engage with the females thread 14 of the shank 10, an axial hole 24 extending vertically along the axis o the shank 10 and a groove 26 formed over the axial hole 24. In addition, the closure member 20 has a pinhole 28 whose axis extends across the groove 26. A blade carriage 30 is positioned on the groove 26 of the closure member 20 and is pivotably mounted on the closure member 20 by means of a pin 50.

As best shown in FIG. 2, the blade carriage 30 includes a blade-carrying head 32 and a lever 34 extending rearwardly from the head 32 toward its pivot point. The lever 34 has an aperture 36 formed in an alignment with the axial hole 24 of the closure member 20, a cutout 38 provided around the aperture 36 and a pinhole 39 through which the pin 50 passes. As can be seen from FIG. 3, the blade carriage 30 is pivotable between a first position in which the lever 34 is substantially perpendicular to the axis of the shank 10 and a second position which is angularly spaced a predetermined degree from the first position.

The blade carriage 30 of the construction described above is normally biased toward the first position by means of a biasing means 40. According to the first embodiment of the invention, he biasing means 40 includes an elongate stem 46 extending through the aperture 36 o the lever 34 and then the axial hole 24 of the closure member 02. This stem 46 has a first enlarged end or nut 42 accepted to hook the lever 34 and a second enlarged end 44 received within the bore 12 of the shank 10. Further, the biasing means 40 includes a cylindrical casing 48 accommodated within the bore 12 for enclosing the second end 44 of the stem 46 and a compression spring 49 held around the stem 46 and retained between the top of the casing 48 and the second enlarged end 44 of the stem 46. As is clear from FIG. 2, the cylindrical casing 48 is divided into an upper half **48*a* and a lower half 48*b*, both of which are threadedly engaged with each other. It should be noted that the upper half 48*a* has a hole through which the stem 46** is inserted.

In operation, when the safety razor is not used, the blade carriage 30 is maintained in the first position shown by a phantom line in FIG. 3 under the action of the biasing means 40. In contrast, when the safety razor is in use, the blade carriage 30 will be pivoted to the second position shown by a solid line in FIG. 3 against the spring force of the biasing means 40.

Figure 4:
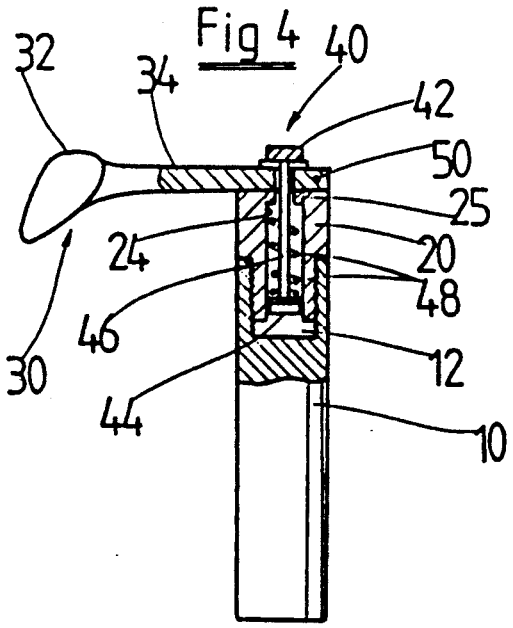
FIG. 4 is a partially cutaway, side elevational view of the safety razor in accordance with the second embodiment of the present invention.
Figure 5:
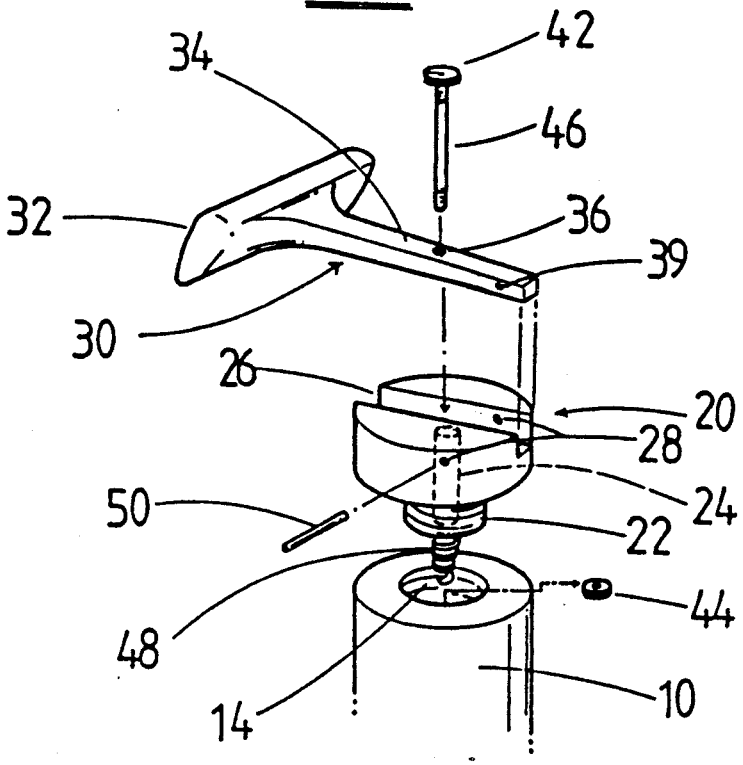
FIG. 5 is an exploded perspective view of the safety razor as illustrated in FIG. 4.

Referring to FIGS. 4 and 5, the safety razor in accordance with the second embodiment of the invention comprises an elongate shank 10 having a blind bore 12 opened at its top edge. A female thread 14 is formed along the entire length of the bore 12. As in the first embodiment, a closure member 20 is threadedly engaged with the shank 10 to close off the bore 12 of the elongate shank 10. The closure member 20 includes a male thread 22 adapted to engage with the female thread 14 of the shank 10, an axial hole 24 extending vertically along the axis of the shank 10, a stopper 25 formed at the top of the axial hole 24 and a groove 26 formed over the axial hole 24. Moreover, the closure member 20 has a pinhole 28 whose axis extends across the groove 26. A blade carriage 30 is positioned on the groove 26 of the closure member 20 and is pivotably mounted on the closure member by means of a pin 50.

The blade carriage 30 includes a blade-carrying head 32 and a lever 34 extending rearwardly from the head 32 toward its pivot point. The lever 34 has an aperture 36 formed in alignment with the axial hole 24 of the closure member 20 and a pinhole 39 through which the pin 50 passes as shown in FIG. 5. The blade carriage 30 is pivotable between a first position in which the lever 34 is substantially perpendicular o the axis of the shank 10 is second position which is angularly spaced a predetermined degree from the first position.

The blade carriage 30 set forth above is normally biased toward the first position by means of a biasing means 40. Unlike the first embodiment, he biasing means 40 includes an elongate stem 46 extending through the aperture 36 of the lever 34 and then the axial hole 24 of the closure member 20. The stem 46 has a first enlarged end 42 adapted to hook the lever 34 and a second enlarged end or nut 44 received in the axial hole 4 of the closure member 20. Further, the biasing means 40 includes a compression spring 48 held around the stem 46 and retained between the stopper 25 of the closure member 20 and the second enlarged end 44 of the stem 26. Since the operation of the safety razor of the second embodiment is the same as described above in connection with the first embodiment, no further description will be given in this regards.

Figure 6:
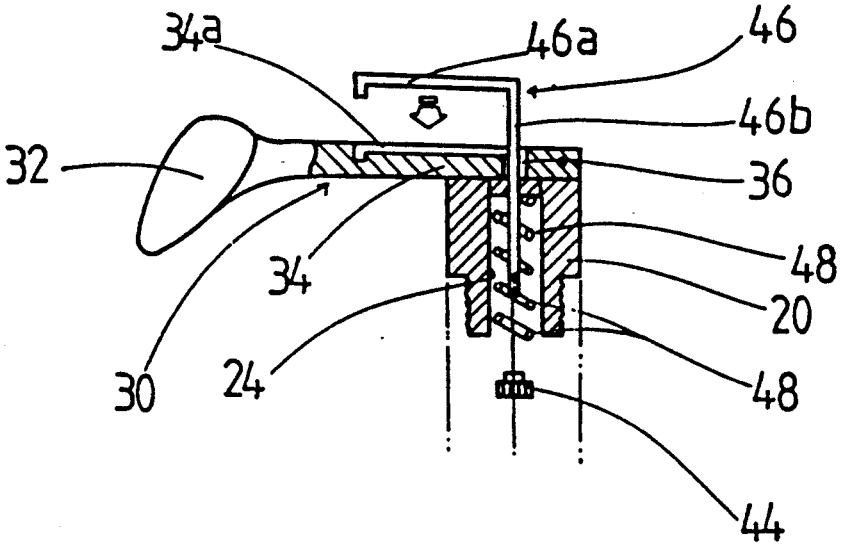
FIG. 6 shows a modification o the safety razor in accordance with the second embodiment of the present invention.

FIG. 6 illustrates a modification of the safety razor employing a stem 46 which differs from that of the first and the second embodiments. More specifically, the stem 46 of the modified embodiment has a vertical extension **46*b* inserted through the axial hole 24 of the closure member 20 and a horizontal extension 46*a* extending from the top end of the vertical extension 46*b* toward the head 32 of the blade carriage 30. A nut 44 is tightened to the lower end of the vertical extension 46*b*. Additionally, type lever 34 of the blade carriage 30 has an elongate groove 34*a* for accommodating the horizontal extension 46*a*** therein.

Although the present invention has been described with reference to certain preferred embodiments, it will be apparent to those skilled in the art that many changes and modification may be made without departing from the scope and spirit of the invention as defined in the claims.

What is claimed is:

1. A safety razor carrying a blade which is pivotable to various angular positions with respect to a user's face, comprising:

an elongate shank having a blink bore at the top thereof;

a closure member removably secured to the elongate shank for closing off the bore o the shank, said closure member having an axial hole formed along an axis of the shank;

a blade carriage pivotably mounted on he closure member, said blade carriage including a blade carrying head and a lever extending rearwardly form the head over the axial hole of the closure member to its pivot point, said blade carriage pivotable between a first position in which the lever is substantially perpendicular to the axis o the shank and a second position which is angularly spaced a predetermined degree from the first position, said lever having an aperture formed in alignment with the axial hole of the closure member; and means, mounted through the aperture of the lever and the axial hole o the closure member, for biasing the blade carriage toward the first position.

2. The safety razor as recited in claim 1, wherein said biasing means includes: an elongate stem extending through the aperture of the lever and the axial hole of the closure member, said stem having a first enlarged end adapted to hold, the lever and a second enlarged end received within the bore of the shank; a cylindrical casing accommodated within the bore of enclosing the second enlarged end of the stem; and a compression spring held around the stem and retained between the top of the casing and the second enlarged end of the stem.

3. The safety razor as recited in claim 1, wherein aid biasing means includes: an elongate stem extending through the aperture of the lever and the axial hole o the closure member, said stem having a first enlarged end located to hook the lever and a second enlarged end received within the axial hole of the closure member; and a compression spring inserted around the stem and retained between the stop of the closure member and the second enlarged end of the stem.

* * * * *